United States Patent [19]

Benaben et al.

[11] Patent Number: 4,612,091

[45] Date of Patent: Sep. 16, 1986

[54] CHROMIUM ELECTROPLATING TRIVALENT CHROMINUM BATH THEREFORE AND METHOD OF MAKING SUCH BATH

[75] Inventors: Patrick Benaben, l'Horme; René Tardy, Firminy, both of France

[73] Assignee: Asociation pour la Recherche et le Developpement des Methodes et Processus Industriels, Paris, France

[21] Appl. No.: 712,476

[22] Filed: Mar. 18, 1985

Related U.S. Application Data

[63] Continuation of Ser. No. 509,061, Jun. 29, 1983, abandoned.

[30] Foreign Application Priority Data

Jun. 30, 1982 [FR] France ..... 82 11488

[51] Int. Cl.[4] ..... C25D 3/06

[52] U.S. Cl. ..... 204/51; 423/492

[58] Field of Search ..... 204/51; 423/492

[56] References Cited

U.S. PATENT DOCUMENTS

| | | | |
|---|---|---|---|
| 1,706,642 | 12/1972 | Brannan | 204/51 |
| 1,797,357 | 3/1931 | McCullough et al. | 204/51 |
| 1,838,777 | 12/1931 | McCullough et al. | 204/51 |
| 1,922,853 | 8/1933 | Kissel | 204/51 |
| 2,524,803 | 10/1950 | Iler | 423/492 |
| 2,928,723 | 3/1960 | Perrin et al. | 423/492 |
| 3,414,492 | 12/1968 | Oleson et al. | 204/51 |
| 3,419,481 | 12/1968 | Nelson | 204/51 |
| 3,442,777 | 5/1969 | Woods et al. | 204/51 |
| 4,054,494 | 10/1977 | Gyllenspetz et al. | 204/43 T |
| 4,167,460 | 9/1979 | Tomaszewski | 204/51 |

FOREIGN PATENT DOCUMENTS

| | | | |
|---|---|---|---|
| 2213991 | 8/1974 | France | 204/51 |
| 2254657 | 7/1975 | France | 204/51 |
| 2305510 | 10/1976 | France | 204/51 |
| 2319721 | 2/1977 | France | 204/51 |
| 2322217 | 3/1977 | France | 204/51 |
| 2335624 | 7/1977 | France | 204/51 |
| 2362948 | 3/1978 | France | 204/51 |
| 2382521 | 9/1978 | France | 204/51 |
| 2441003 | 6/1980 | France | 204/51 |
| 2460344 | 1/1981 | France | 204/51 |
| 2474538 | 7/1981 | France | 204/51 |
| 301478 | 2/1929 | United Kingdom | 204/51 |
| 292094 | 8/1929 | United Kingdom | 204/51 |
| 1144913 | 3/1969 | United Kingdom | 204/51 |
| 2086939 | 5/1982 | United Kingdom | 204/51 |
| 475346 | 9/1975 | U.S.S.R. | 423/492 |
| 582205 | 1/1978 | U.S.S.R. | 423/492 |

OTHER PUBLICATIONS

Larissa Domnikov, Metal Finishing, pp. 107–109, Jun. 1966.

Chemical Abstracts, vol. 95, 1981, paragraph 72414x.

*Primary Examiner*—G. L. Kaplan

*Attorney, Agent, or Firm*—Sandler & Greenblum

[57] ABSTRACT

The present invention relates to an electrolysis bath based on trivalent chromium.

This bath is characterized in that it contains a trivalent chromium halide which is neither chelated by a chelating product of chromium nor accompanied by a special organic solvent.

Due to simple operational characteristics, this bath makes it possible to obtain commercially interesting results since, with respect to the color, thickness and hardness of the deposits obtained, very close to those of conventional baths based on hexavalent chromium, this with the advantage, over the latter, of having a speed and a yield of deposit which are much greater and conditions of use which are less toxic and less polluting.

16 Claims, No Drawings

CHROMIUM ELECTROPLATING TRIVALENT CHROMINUM BATH THEREFORE AND METHOD OF MAKING SUCH BATH

This application is a continuation of application Ser. No. 509,061 filed June 29, 1983 and now abandoned.

The present invention relates to an electrolysis bath based on trivalent chromium.

To effect an electrolytic deposit of chromium or chromium plating, an aqueous solution of concentrated chromic acid (hexavalent chromium) is currently used in the presence of catalyst ions (of sulfate or fluoride type), or an organic or half-aqueous half-organic solution of trivalent chromium. The use of an electrolysis bath based on trivalent chromium is preferable, as it presents numerous advantages.

In fact, for baths based on hexavalent chromium, the current yield obtained is medium, the losses of chromium element are very high and the high toxicity of the chromic acid raises a certain number of problems. During recent years, numerous processes have attempted to replace hexavalent chromium by trivalent chromium. The trivalent chromium salt employed is of very variable nature and many processes specify its particular method of manufacture. The methods of reduction of hexavalent chromium into trivalent chromium, by organic or inorganic reducing agents, known for a very long time, constitute one of the interesting means for manufacturing trivalent chromium salts. However, up to the present, the trivalent chromium salts obtained from these different reductions cannot be used directly for chromium-plating by electrodeposit: it is indispensable to convert the salt of trivalent chromium issuing from the reduction into a new compound (in particular into an organic or inorganic complex, most often), and, for chromium-plating to be possible, to accompany the new compound of trivalent chromium with products judged indispensable. This is the particular case of prior art Patents GB Pat. Nos. 1 144 913 and 2 086 939, FR Pat. Nos. 2 254 657, 2 305 510, 2 319 721, 2 322 217, 2 335 624, 2 362 948, 2 382 521 and 2 441 003. These impose chelation of the trivalent chromium salt, the addition of various products or the use of half-aqueous, half-organic electrolysis baths.

Furthermore, for a bath based on trivalent chromium to be able, industrially and with profit, to replace the conventional baths, based on hexavalent chromium, it should be able to make it possible to effect:

- a decorative chromium-plating with a colour of deposit identical to that of a hexavalent chromium,
- a hard chromium-plating with a sufficient thickness to lend itself to a comparison with the hard chromium-plating produced with the hexavalent chromium baths.

Processes describe the obtaining of thick chromium from trivalent chromium compounds, but, as a general rule, they impose the strict separation of the anodic and cathodic compartments, which imposes difficult technical constraints of exploitation.

At first sight, only the patents relating to chromium-plating based on trivalent chromium (FR Pat. Nos. 2 441 003, 2 460 344, 2 474 538) appear to contribute a valid answer, the first for obtaining a decorative chromium, the second a thick chromium and the third both a decorative chromium and a thick chromium. However, in the first two Patents, the chromium released in chromium-plating comes from a trivalent chromium complex and:

- in FR Pat. No. 2 441 003, the concentration of chromium in the electrodeposit solution must be less than 0.03M
- in the second Patent, FR Pat. No. 2 460 344, it is necessary to effect chromium-plating in several steps to have a chromium five microns thick.

Only FR Pat. No. 2 474 538 contributes a simple and complete answer to the problems raised above.

Essentially, it relates:

(1) to the use of a trivalent chromium sulfate, not introduced in a complex, in a simple reactional medium, in particular bereft of the indispensable presence of special, organic or inorganic solvent.

(2) to particular operational characteristics of the bath, made with this trivalent chromium salt, making it possible to obtain, simply, commercially interesting results, since, with respect to the colour and thickness of the chromium deposited, very close to those obtained with the conventional baths based on hexavalent chromium.

If such a process proved to give satisfactory results, it has been observed that it was possible, whilst maintaining the commercial interest described under (2) above, to extend the field of application to baths using a trivalent chromium halide and, by judiciously selecting the constituents of these baths, to improve the performances obtained.

According to the invention, this electrolysis bath based on trivalent chromium is constituted by a solution obtained by careful reduction, by a reducing agent such as alcohol, hydrogen peroxide, hyposulfite, sulfur dioxide, of chromium trioxide in a hydrochloric medium.

The trivalent chromium salt obtained:

is not included in a complex (in particular in any complex between trivalent chromium and ions with $OH^-$ base or hexavalent chromium and organic molecule).

can be used directly for a chromium-plating operation, as from the end of the reduction of the chromium trioxide, without indispensable addition of additional products, in particular chelating product of the trivalent chromium or organic solvent for the chromium-plating operation to be able to start; and correct functioning of this bath is associated only with the presence of ions $Cr^{3+}$, of halide ions, of molecules of water and of ions $H^+$.

The chromium trioxide solution may possibly contain sulfuric or hydrobromic ions but no additional adjuvant is indispensable for correct functioning of the bath.

The electrolysis bath according to the invention may be used without separation of the anodic and cathodic compartments.

The anode used for the chromium-plating operation is constituted by a material which may withstand a separation of chlorine and allowing the least possible formation of hexavalent chromium by anodic oxidation. Carbon anodes which give excellent results are preferably used with the bath according to the invention.

The general conditions of use of the bath are as follows:

- density of cathodic current greater than 10 A/dm2;
- concentration of chromium: from 0.1 to 1 gram-ion per liter of trivalent chromium, or 5.2 to 51.99 g/l of $Cr^{3+}$;
- pH less than 1.5 and close to 1;
- temperature ambient;

current yield (calculated according to Faraday's law): greater than 30%.

The use of an electrolysis bath according to the invention offers numerous advantages. The bath is very simple to make and its cost price is reduced. The concentration of the chromium in the bath being low, the losses of chromium by mechanical entrainment are limited. The absence of separation of the anodic and cathodic compartments allows chromium-plating of complex pieces. As trivalent chromium is used, the problems of toxicity and of treatment of the effluents are reduced. The electrolysis bath tolerates the interruption of electrical current and it may be applied to different materials.

This electrolysis bath makes it possible to deposit on conductive substances a deposit of decorative chromium of colour identical to that obtained by the processes of chromium-plating with hexavalent chromium, with a concentration of the solution in trivalent chromium which is between 0.1 and 1 g-ion/l (5.2 to 51.99 g/l of $Cr^{3+}$).

Similarly, concerning the thick chromium, the bath according to the invention makes it possible to deposit on conductive substances a coating of chromium with a thickness greater than several tens of microns and even exceeding a hundred microns, a dense deposit, adherent and shiny, of hardness greater than one thousand Vickers.

These thick chromium deposits are made in one electrolysis operation without, as indicated above, having to separate the anodic and cathodic compartments, and without having to change the composition of the bath in the course of chromium-plating.

The bath according to the invention, in addition to the possible addition of conducting salts such as NaCl, KCl, $NH_4Cl$, tolerates the products currently used in chromium-plating to improve the performances of the baths.

The results of tests carried out with various electrolysis baths according to the invention will be given below by way of non-limiting examples:

(1) Concentration in $Cr^{III}$: 0.2 ion g/l

| | |
|---|---|
| Anode: graphite | Potential: 7.5 V |
| Cathode: copper | Cathodic current density: |
| Time of deposit: 5 mins. | 25 A/dm |
| Temperature: 22° C. | Cathodic surface: 10.4 $cm^2$ |
| Yield: 29.2% | Average thickness of |
| Speed of deposit: | chromium deposited: 5.6 microns |
| 1.1 $\mu m \cdot mn^{-1}$ | |

Appearance of deposit: adherent, shiny (2) Concentration in $Cr^{III}$: 0.3 ion g/l, with addition of KCl: 70 g/l

| | |
|---|---|
| Anode: graphite | Potential: 5.1 V |
| Cathode: copper | Cathodic current density: |
| Time of deposit: 5 mins. | 30 $A/dm^2$ |
| Temperature: 22° C. | Cathodic surface: 10 $cm^2$ |
| Yield: 24% | Average thickness of chromium |
| Speed of deposit: | deposited: 5.1 microns |
| 1 $\mu m \cdot mn^{-1}$ | |

Appearance of the deposit: adherent, shiny, colour identical to that of the chromium deposited from the hexavalent chromium baths.

(3) Concentration in $Cr^{III}$: 0.35 ion g/l

| | |
|---|---|
| Anode: graphite | Potential: 7.4 V |
| Cathode: copper | Cathodic current density: |
| Time of deposit: 33 mins. | 30 $A/dm^2$ |
| Temperature: 20 to 25° C. | Cathodic surface: 10 $cm^2$ |
| Yield: 32% | Average thickness of chromium |
| Speed of deposit: | deposited: 50 microns |
| 1.5 $\mu m \cdot mn^{-1}$ | |

Appearance of the deposit: adherent, dense, slightly matt, colour identical to that of the chromium deposited from the hexavalent chromium baths.

(4) Concentration in $Cr^{III}$: 0.4 ion g/l

| | |
|---|---|
| Anode: graphite | Potential: 7 V |
| Cathode: copper | Cathodic current |
| Time of deposit: 150 mins. | density: 25 A/dm2 |
| Temperature: 22° C. | Cathodic surface: 10 $cm^2$ |
| Yield: 29% | Average thickness of |
| Speed of deposit: | chromium deposited: |
| 1.1 $\mu m \cdot mn^{-1}$ | 175 microns |

Appearance of the deposit: adherent, rough, colour identical to that of the chromium deposited from the hexavalent chromium baths.

As may be seen from the above-mentioned examples, the electrolysis bath makes it possible to use a difference in potential of the order of 5 volts (Example 2) and the deposits obtained are always of excellent quality, even when the average thickness of the deposit obtained is greater than 100 microns (Example 4).

We claim:

1. A method of forming an electroplating bath for electroplating metallic chromium, wherein said bath is composed of an aqueous solution of halogenated trivalent chromium ions, wherein said method comprises the step of completely reducing a sufficient quantity of chromium trioxide in a hydrochloric acid medium so as to produce a bath having a pH of less than 1.5 and a concentration of $Cr^{3+}$ ions between 5.2 and 51.99 g/l, wherein said reducing step comprises the steps of:

(i) reducing chromium trioxide with a reducing agent selected from the group consisting of: alcohol, hydrogen peroxide, hyposulfite, and sulfur dioxide; and (ii) producing $Cr^{3+}$ ions as a result of reducing step (i) that are always unchelated and uncomplexed with a material selected from the group consisting of: hydroxyl containing ions and organic molecules.

2. The method defined by claim 1 wherein said method comprises only steps (i) and (ii) so as to produce a bath having a pH of less than 1.5 and a concentration of trivalent chromium ions between 5.2 and 51.99 g/l.

3. A method of electrolytically plating a dense layer of metallic chromium on a conductive substrate using a bath composed of an aqueous solution of halogenated trivalent chromium ions wherein said method comprises the steps of:

(a) completely reducing a sufficient quantity of chromium trioxide in a hydrochloric acid medium with a reducing agent selected from the group consisting of: alcohol, sulfur dioxide, hyposulfite, and hydrogen peroxide so as to produce a bath having a pH of approximately 1 and having between 5.2 and 51.99 g/l of trivalent chromium ions that are always uncomplexed and unchelated with a material selected from the group consisting of hydroxyl containing ions and organic molecules;

(b) passing a current greater than 10 A/dm$^2$ between unseparated anodic and cathodic compartments to electroplate and metallic chromium on said substrate;

(c) maintaining said $Cr^{3+}$ ions in their unchelated and uncomplexed state throughout electroplating:

(d) maintaining a pH of approximately 1 throughout electroplating;

(e) maintaining said concentration of $Cr^{3+}$ ions at between 5.2 and 51.99 g/l throughout electroplating;

(f) maintaining the composition of said bath produced in step (a) without change throughout electroplating; and (g) maintaining a lack of separation between said anodic and cathodic compartments throughout electroplating.

4. The method defined by claim 3 further comprising the steps of:

(d) passing a current of at least 25 amperes per square decimeter between said cathodic compartment and said anodic compartment; and (e) depositing trivalent chromium ions on said substrate at a rate greater than 1 micron per minute.

5. The method defined by claim 4 further comprising the step of depositing metallic chromium having a thickness of approximately 175 microns on said substrate.

6. The method defined by claim 3 wherein said method further comprises depositing metallic chromium having a reflective appearance on said substrate.

7. An electrolysis bath comprising an aqueous solution of halogenated trivalent chromium ions having a pH of less than 1.5, and a concentration of $Cr^{3+}$ ions of between 5.2 and 51.99 g/l, wherein said trivalent chromium ions are uncomplexed and unchelated with a material selected from the group consisting of: hydroxyl containing ions and organic molecules, wherein said bath is made by the process comprising the steps of:

completely reducing a sufficient quantity of chromium trioxide in a hydrochloric acid medium so as to produce between 5.2 and 51.99 g/l of $Cr^{3+}$ ions having a pH of less than 1.5, wherein said reducing step comprises the step of:

reducing chromium trioxide with a reducing agent selected from the group consisting of: alcohol, hydrogen peroxide, sulfur dioxide, and hyposulfite so as to produce $Cr^{3+}$ ions that are always uncomplexed and unchelated with a material selected from the group consisting of hydroxyl containing ions and organic molecules.

8. The electrolysis bath defined by claim 7 wherein said bath is made by the process comprising only the steps of:

completely reducing a sufficient quantity of chromium trioxide in a hydrochloric acid medium so as to produce between 5.2 and 51.99 g/l of trivalent chromium ions having a pH of less than 1.5, wherein said reducing step comprises only the step of:

reducing chromium trioxide with a reducing agent selected from the group consisting of: alcohol, hydrogen peroxide, sulfur dioxide, and hyposulfite so as to produce trivalent chromium ions that are always uncomplexed and unchelated with a material selected from the group consisting of: hydroxyl containing ions and organic molecules.

9. A method of electrolytically plating metallic chromium from a solution of trivalent chromium ions on a substrate comprising the steps of:

(a) completely reducing chromium trioxide in a hydrochloric acid medium to produce a bath of trivalent chromium ions having a pH of less than 1.5 and that are uncomplexed and unchelated with a material selected form the group consisting of: hydroxyl containing ions and organic molecules;

(b) passing a current through said bath between an anodic and a cathodic compartment to electroplate said metallic chromium said substrate; and (c) maintaining said trivalent chromium ions in their uncomplexed and unchelated state throughout electroplating.

10. The method defined by claim 9 wherein step (a) further comprises the step of reducing a sufficient quantity of chromium trioxide so as to produce between 5.2 and 51.99 g/l of trivalent chromium ions.

11. The method defined by claim 10 wherein said method further comprises the step of maintaining the concentration of trivalent chromium ions between 5.2 and 51.99 throughout electroplating.

12. The method defined by claim 9 wherein step (a) further comprises the step of reducing said chromium trioxide with a reducing agent selected from the group consisting of: alcohol, sulfur dioxide, hyposulfite, and hydrogen peroxide.

13. The method defined by claim 9 wherein step (b) further comprises the step of passing a current of greater than 10 A/dm$^2$ between said anodic and said cathodic compartments.

14. The method defined by claim 9 wherein said step (b) further comprises the step of passing said current between unseparated cathodic and anodic compartments and wherein said method further comprises the step of maintaining the separation between said anodic and cathodic compartments during electroplating.

15. The method defined by claim 9 further comprising the step of maintaining the pH of said bath at approximately 1 throughout electroplating.

16. The method defined by claim 9 further comprising the step of maintaining the composition of said bath produced in step (a) without change throughout electroplating.

* * * * *